US007234517B2

(12) United States Patent
Streich et al.

(10) Patent No.: US 7,234,517 B2
(45) Date of Patent: Jun. 26, 2007

(54) SYSTEM AND METHOD FOR SENSING LOAD ON A DOWNHOLE TOOL

(75) Inventors: Steven G. Streich, Duncan, OK (US); Roger L. Schultz, Aubrey, TX (US); James C. Tucker, Springer, OK (US); Lee Wayne Stepp, Comanche, OK (US); Phillip M. Starr, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 213 days.

(21) Appl. No.: 10/769,121

(22) Filed: Jan. 30, 2004

(65) Prior Publication Data

US 2005/0167094 A1 Aug. 4, 2005

(51) Int. Cl.
*E21B 47/00* (2006.01)
*E21B 43/00* (2006.01)

(52) U.S. Cl. ..... 166/66; 166/250.17; 166/250.01

(58) Field of Classification Search ..... 166/66, 166/250.1, 255.1, 250.17
See application file for complete search history.

(56) References Cited

U.S. PATENT DOCUMENTS

| | | | | |
|---|---|---|---|---|
| 4,067,349 | A | 1/1978 | Austin et al. | 138/97 |
| 4,206,810 | A | 6/1980 | Blackman | 166/336 |
| 4,426,882 | A | 1/1984 | Skinner | 73/155 |
| 4,506,731 | A | 3/1985 | Skinner | 166/113 |
| 4,508,174 | A | 4/1985 | Skinner et al. | 166/373 |
| 4,582,136 | A | 4/1986 | Skinner | 166/250 |
| 4,773,478 | A | 9/1988 | Streich | 166/120 |
| 4,823,881 | A | 4/1989 | Streich | 166/382 |
| 4,866,607 | A | 9/1989 | Anderson et al. | 364/422 |
| 4,999,817 | A | 3/1991 | Zimmer | 367/65 |
| 5,234,057 | A | 8/1993 | Schultz et al. | 166/319 |
| 5,236,048 | A | 8/1993 | Skinner et al. | 166/382 |
| 5,273,113 | A | 12/1993 | Schultz | 166/250 |
| 5,279,363 | A | 1/1994 | Schultz et al. | 166/53 |
| 5,293,937 | A | 3/1994 | Schultz et al. | 166/250 |
| 5,318,137 | A | 6/1994 | Johnson et al. | 175/40 |
| 5,332,035 | A | 7/1994 | Schultz et al. | 166/53 |
| 5,355,960 | A | 10/1994 | Schultz et al. | 166/374 |
| 5,367,911 | A | 11/1994 | Jewell et al. | 73/861.08 |
| 5,412,568 | A | 5/1995 | Schultz | 364/422 |
| 5,490,564 | A | 2/1996 | Schultz et al. | 166/374 |

(Continued)

FOREIGN PATENT DOCUMENTS

WO WO 00/55475 9/2000

OTHER PUBLICATIONS

Article entitled "Silicone Rubber Fiber Optic Sensors" by Jeffrey D. Muhs, Photonics Spectra, 1992, vol. 26, No. 7, pp. 98.

(Continued)

*Primary Examiner*—William Neuder
*Assistant Examiner*—Nicole A Coy
(74) *Attorney, Agent, or Firm*—John W. Wustenberg; Haynes & Boone

(57) ABSTRACT

A system and method for determining load on a downhole tool according to which one or more sensors are embedded in one or more components of the tool or in a material on one or more of the components. The sensors are adapted to sense load on the components.

28 Claims, 2 Drawing Sheets

U.S. PATENT DOCUMENTS

| | | | | |
|---|---|---|---|---|
| 5,899,958 | A | 5/1999 | Dowell et al. | 702/6 |
| 6,070,672 | A | 6/2000 | Gazda | 166/386 |
| 6,131,658 | A | 10/2000 | Minear | 166/250.01 |
| 6,144,316 | A | 11/2000 | Skinner | 340/853.7 |
| 6,229,453 | B1 | 5/2001 | Gardner et al. | 340/853.8 |
| 6,233,746 | B1 | 5/2001 | Skinner | 2/227.18 |
| 6,236,620 | B1 | 5/2001 | Schultz et al. | 367/82 |
| 6,257,332 | B1 | 7/2001 | Vidrine et al. | 166/250.15 |
| 6,273,189 | B1 | 8/2001 | Gissler et al. | 166/241.1 |
| 6,286,596 | B1 | 9/2001 | Schnatzmeyer et al. | 166/250.15 |
| 6,310,559 | B1 | 10/2001 | Laborde et al. | 340/853.2 |
| 6,321,838 | B1 | 11/2001 | Skinner | 166/250.01 |
| 6,328,119 | B1 | 12/2001 | Gillis et al. | 175/325.1 |
| 6,384,738 | B1 | 5/2002 | Carstensen et al. | 340/854.3 |
| 6,394,181 | B2 | 5/2002 | Schnatzmeyer et al. | 166/250.15 |
| 6,598,481 | B1 | 7/2003 | Schultz | 73/702 |
| 6,648,082 | B2 | 11/2003 | Schultz et al. | 175/39 |
| 2001/0013410 | A1 | 8/2001 | Beck et al. | 166/65.1 |
| 2001/0013411 | A1 | 8/2001 | Beck et al. | 166/65.1 |
| 2001/0040033 | A1 | 11/2001 | Schnatzmeyer et al. | 166/250.15 |
| 2001/0042617 | A1 | 11/2001 | Beck et al. | 166/65.1 |
| 2001/0043146 | A1 | 11/2001 | Beck et al. | 340/855.8 |
| 2002/0007970 | A1* | 1/2002 | Terry et al. | 175/92 |
| 2003/0188862 | A1* | 10/2003 | Streich et al. | 166/250.01 |
| 2004/0040707 | A1* | 3/2004 | Dusterhoft et al. | 166/279 |

OTHER PUBLICATIONS

Paper entitled "Integrated Sensing In Structural Composites," by A. Starr et al., dated Sep. 2003.

* cited by examiner

SYSTEM AND METHOD FOR SENSING LOAD ON A DOWNHOLE TOOL

BACKGROUND

This disclosure relates to a system and method for determining load transmitted to a downhole tool in oil and gas recovery operations.

Many downhole tools are subjected to loads during oil and gas recovery operations. For example, packers are used to seal against the flow of fluid to isolate one or more sections, or formations, of a wellbore and to assist in displacing various fluids into the formation and/or retrieving hydrocarbons from the formation. The packers are suspended in the wellbore, or in a casing in the wellbore, from a work string, or the like, consisting of a plurality of connected tubulars or coiled tubing. Each packer includes one or more elastomer elements, also known as packer elements, which are activated, or set, so that they are forced against the inner surface of the wellbore, or casing, and compressed to seal against the flow of fluid and therefore to isolate certain zones in the well. Also, mechanical slips are located above and/or below the packer elements and, when activated, are adapted to extend outwardly to engage, or grip, the casing or wellbore.

The packer is usually set at the desired depth in the wellbore by picking up on the work string at the surface, rotating the work string, and then lowering the work string until an indicator at the surface indicates that some of the slips, usually the ones located below the packer elements, have extended outwardly to engage the casing or wellbore. As additional work string weight is set down on the engaged slips, the packer elements expand and seal off against the casing or wellbore. Alternately, the packer can be set by establishing a hydraulic pressure into a setting mechanism by the work string. The setting mechanism then extends, sets the packer, and expands all slips to engage the casing or wellbore.

Usually, the setting and sealing is accomplished due to the fact that the packer elements are kept sealed against the casing or wellbore by the weight, or load, of the work string acting against the slips. It can be appreciated that it would be advantageous to be able to monitor, evaluate, and, if necessary, vary, the load transmitted to the packer and other downhole packers. Although a weight indicator has been provided at the surface for this purpose, it is often difficult to determine exactly how much load is being transmitted due, for example, to buckling and corkscrewing of the work string, irregular wellbore diameters, etc.

Therefore, what is needed is a system and method for sensing and monitoring the load transmitted to a downhole packer in the above manner so that the load can be evaluated and, if necessary, adjusted.

DETAILED DESCRIPTION

Figure 1:
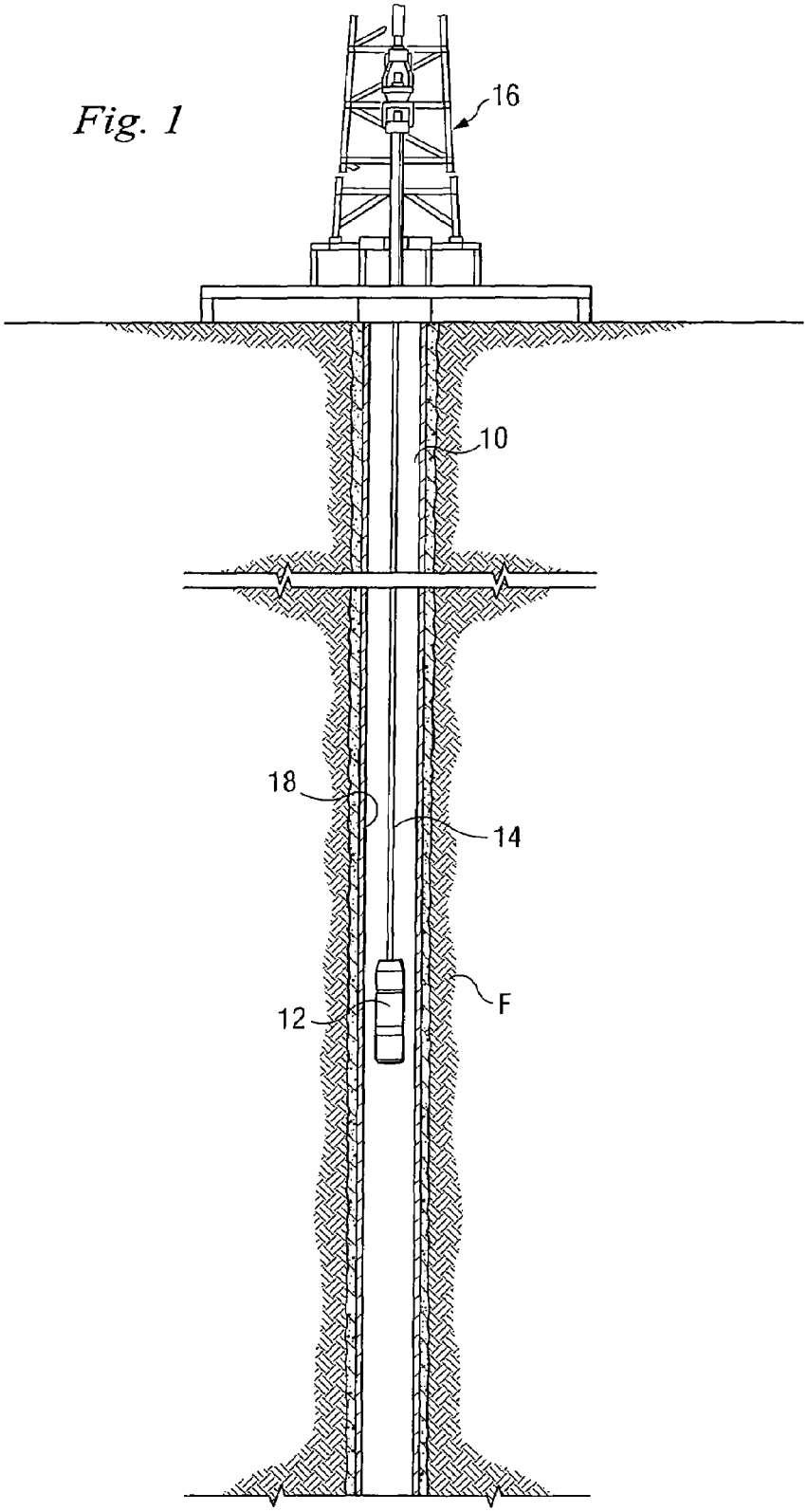
FIG. 1 is a partial sectional/partial elevational view of a downhole oil and gas recovery operation utilizing a tool according to an embodiment of the invention.

Referring to FIG. 1, the reference numeral 10 refers to a wellbore penetrating a subterranean formation F for the purpose of recovering hydrocarbon fluids from the formation F. A tool 12, in the form of a packer, is located at a predetermined depth in the wellbore 10, and a work string 14, in the form of jointed tubing, coiled tubing, wireline, or the like, is connected to an upper end of the packer 12. The tool 12 is shown generally in FIG. 1 and will be described in detail later.

The work string 14 extends from a rig 16 located above ground and extending over the wellbore 10. The rig 16 is conventional and, as such, includes support structure, draw works, a motor driven winch, and/or other associated equipment for receiving and supporting the work string 14 and the tool 12 and lowering the packer 12 to the predetermined depth in the wellbore 10.

The wellbore 10 can be lined with a casing 18 which is cemented in the wellbore 10 by introducing cement in an annulus formed between an inner surface of the wellbore 10 and an outer surface of the casing 18, all in a conventional manner.

Figure 2:
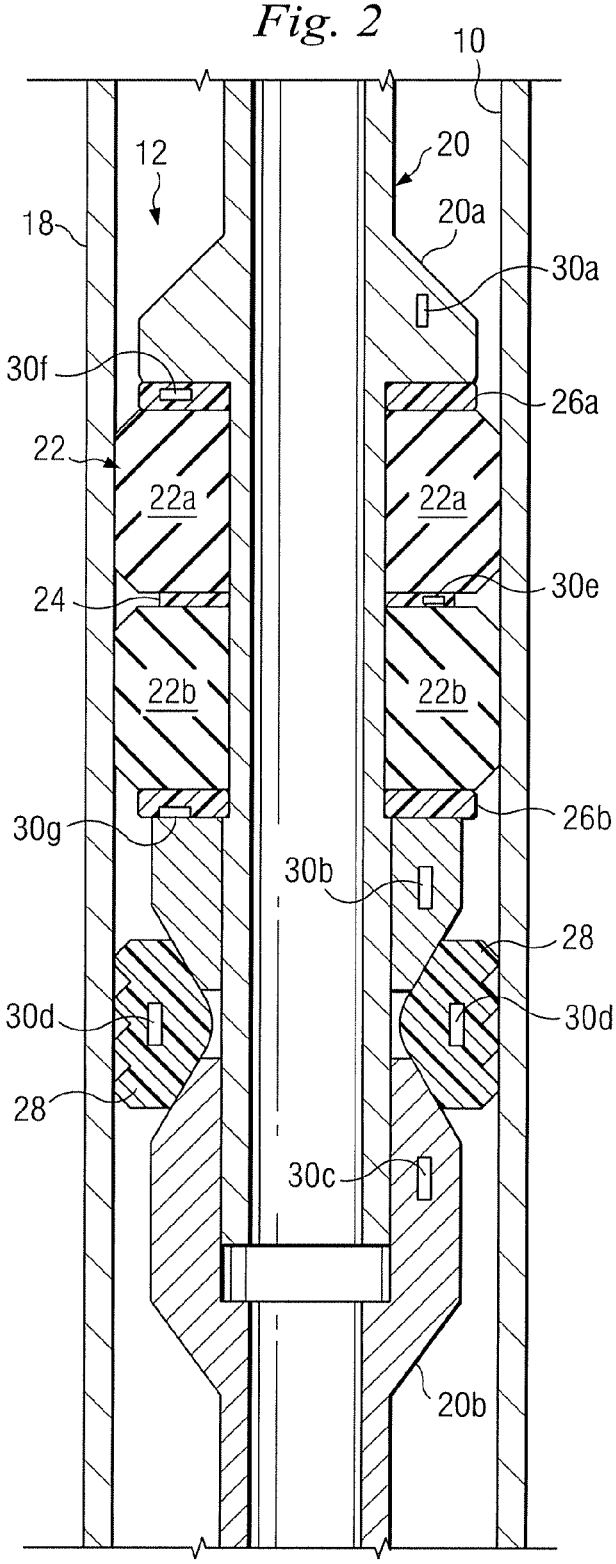
FIG. 2 is a cross-sectional view of the tool of FIG. 1.

The tool 12 is shown in detail in FIG. 2 and includes a mandrel 20 formed by two telescoping mandrel sections 20*a* and 20*b*, with an upper end portion of the mandrel section 20*b*, as viewed in FIG. 2, extending over a lower end portion of the mandrel section 20*a*. An upper end of the mandrel section 20*a* is connected to the work string 14 (FIG. 1).

Packer element 22 comprises two axially-spaced annular packer elements 22*a* and 22*b* extending around the mandrel section 20*a* and between a shoulder formed on the mandrel section 20*a* and the corresponding end of the mandrel section 22*b*. The packer elements 22*a* and 22*b* are adapted to be set, or activated, in the manner discussed above which causes them to extend radially outwardly to the position shown in FIG. 2 to engage the inner surface of the casing 18 and seal against the flow of fluids to permit the isolation of certain zones in the well.

The packer element 22*b* is spaced axially from the packer element 22*a*, and a spacer ring 24 extends around the mandrel section 20*a* and between the packer elements 22*a* and 22*b*. A shoe 26*a* extends around the mandrel section 20*a* just above an upper end of the packer element 22*a*, and a shoe 26*b* extends around the mandrel section 20*a* just below a lower end of the packer element 22*b*.

A plurality of mechanical slip elements 28, two of which are shown in FIG. 2, are angularly spaced around the mandrel section 22*b* with a portion of each extending in a groove formed in the outer surface of the mandrel section 22*b*. The slip elements 28 are adapted to be set, or activated, in the manner discussed above to cause them to extend radially outwardly to the position shown in FIG. 2 to engage, or grip, the inner surface of the casing 18 to hold the tool 12 in a predetermined axial position in the wellbore 10.

Three axially-spaced sensors 30*a*, 30*b*, and 30*c* are located on the mandrel 20, and a sensor 30*d* is located on each slip element 28. Three additional sensors 30*e*, 30*f*, and 30*g* are located on the spacer ring 24, the shoe 26*a*, and the shoe 26*b*, respectively.

Before the sensors 30*a*-30*g* are applied to the tool 12 in the above locations, they are embedded in a non-metallic material and the material is applied to the tool. For example, the sensors 30*a*-30*g* can be embedded in a laminated structure including multiple sheets of material that are laminated together. Each sheet is formed of a composite material including a matrix material, such as a polymer and a braid impregnated in the matrix material. The braid could be in the form of a single strand or multiple strands woven in a fabric form. The sensors 30*a*-30*g*, along with the necessary electrical conductors, are placed either in the matrix material or within the braided strands of the braid. The sheets are adhered together with an adhesive, a plastic material, or the like, to form the laminated structure. Alternately the sensors 30*a*-30*g* could be located between adjacent sheets in the above laminated structure.

The laminated structure thus formed, including the sensors 30*a*-30*g*, can be attached to an appropriate surface of the mandrel 20, the slip elements 28, the spacer ring 24, and/or the shoes 26*a* and 26*b* in any conventional manner, such as by adhesive, or the like, or they can be placed loosely against an appropriate structure.

The above-mentioned electrical conductors associated with the sensors 30*a*-30*g* are connected to appropriate apparatus for transmitting the output signals from the sensors 30*a*-30*g* to the ground surface. For example, each sensor 30*a*-30*g* can be hardwired to central storage/calibration electronics (not shown) at the ground surface using electrical conductors or fiber optics. Alternately, data from the sensors 30*a*-30*g* can be transmitted to central storage/calibration electronics at the ground surface via high-frequency, radio frequency, electromagnets, or acoustic telemetry. Also, it is understood that each sensor 30*a*-30*g* can be set up to store data independently from the other sensors and the stored data can be accessed when the tool 12 is returned to the ground surface.

Alternately, one or more of the mandrel 20, the spacer ring 24, and/or the shoes 26*a* and 26*b* can be fabricated from the above laminated structure including the sensors 30*a*-30*g* and the appropriate electrical conductors. A technique of incorporating sensors in structure not related to downhole tools is disclosed in a paper entitled "Integrated Sensing in Structural Composites" presented by A. Starr, S. Nemat-Nasser, D. R. Smith, and T. A. Plaisted at the 4$^{th}$ Annual International Workshop for Structural Health Monitoring at Stanford University on Sep. 15, 2003, the disclosure of which is incorporated herein by reference in its entirety.

In each of the above cases, all loads transmitted to the mandrel 20, the slip elements 28, the spacer ring 24, and/or the shoes 26*a* and 26*b* are sensed by the sensors 30*a*-30*g*.

The sensors 30*a*-30*g* can be in the form of conventional strain gauges which are adapted to sense the stress in the mandrel 20, the packer element 22, the slip elements 28, the spacer ring 24, and the shoes 26*a* and 26*b* and generate a corresponding output signal. An example of this type of sensor is marketed under the name Weight-on-Bit (WOB)/Torque Sensor, by AnTech in Exeter, England and is disclosed on Antech's Internet website at the following URL address: http://www.antech.co.uk/index.html, and the disclosure is incorporated herein by reference in its entirety.

The sensors 30*a*-30*g* can be connected in a conventional Wheatstone bridge with the measurements of strain (elongation) by the sensors 30*a*-30*g* being indicative of stress level. As a result, the load on the mandrel 20, the packer element 22, the slip elements 28, the spacer ring 24, and the shoes 26*a* and 22*b* can be calculated as follows:

$$L=S(A)$$

where:

L is the applied load on the mandrel 20, the packer element 22, the slip elements 28, the spacer ring 24, and the shoes 26*a* and 26*b;*

S is the stress which equals the measured strain times the modulus of elasticity which is a constant for the material of the mandrel 20, the slip elements 28, the spacer ring 24, and the shoes 26*a* and 26*b;* and A is the cross-section area of the mandrel 20, the slip elements 28, the spacer ring 24, and the shoes 26*a* and 26*b*.

It is understood that, additional electronics, such as a power supply, a data storage mechanism, and the like, can be located anywhere on the tool 12 and can be associated with the sensors 30*a*-30*g* to enable and assist the sensors 30*a*-30*g* to function in the above manner. Since these electronics are conventional they are not shown nor will they be described in detail.

The sensors 30*a*-30*g* can be set up to store data independently from the other sensors, or can be "hardwired" to central storage/calibration electronics (not shown) using electrical conductors (wire) or fiber optics, or can be connected locally to central storage/calibration electronics via high-frequency, radio/frequency, electromagnetic, or acoustic telemetry.

The readings from all the sensors 30*a*-30*g* can be used individually or can be combined to form a "virtual" sensor anywhere on the tool 12. In other words, the readings from all or a portion of the sensors 30*a*-30*g* can be used to estimate the stress/strain, etc. at any point on the tool 12 including actual sensor locations. Even though one of the sensors 30*a*-30*g* may be present at a location of interest on the tool 12, the accuracy of the measurement may be improved by also using the other sensor measurements as well. Also, a calibration can be performed on the entire tool 12 under various loading conditions, in a manner so that it would not be necessary to precisely align or attach the sensors 30*a*-30*g* in a particular way, since the calibration would compensate for sensor misalignment, etc.

VARIATIONS

1. The number of sensors 30*a*-30*g* that are used on the tool 12 can be varied.

2. The sensors 30*a*-30*g* can be located anywhere on the mandrel 20, the slip elements 28, the spacer ring 24, and the shoes 26*a* and 26*b*, preferably in areas subjected to relatively high strain, and could also be located on one or more of the packer elements 22*a* and 22*b*.

3. The location of the sensors 30*a*-30*g* is not limited to the mandrel 20, the slip elements 28, the spacer ring 24, and the shoes 26*a* and 26*b*, but could be at any area(s) of the tool 12.

4. The sensors 30*a*-30*g* are not limited to strain gauges but rather can be in the form of any type of sensors that sense load.

5. The material in which the sensors 30*a*-30*g* are embedded can vary. For example the material can be an elastomer, ceramic, plastic, glass, foam, or wood with or without the above-mentioned braid integrated therein. Also, the material does not necessarily have to be in the form of sheets or laminated sheets.

6. Although the tool 12 is shown in a substantial vertical alignment in the wellbore 10, it is understood that the packer 12 and the wellbore 10 can extend at an angle to the vertical.

7. The present invention is not limited to sensing loads on packers but rather is applicable to any downhole tool.

8. The spatial references mentioned above, such as "upper", "lower", "under", "over", "between", "outer", "inner", and "surrounding" are for the purpose of illustration only and do not limit the specific orientation or location of the components described above.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A downhole tool adapted to extend within a wellbore, the downhole tool comprising:

at least one sealing element fabricated from a first material and adapted to sealingly engage an inner surface of the wellbore; and a discrete sensor assembly comprising:

a second, non-metallic, material located adjacent the sealing element; and a sensor embedded in the non-metallic material;

wherein, when the downhole tool extends within the wellbore, the sensor is adapted to sense one or more loads transmitted to the at least one sealing element.

2. A downhole tool adapted to extend within a wellbore, the tool comprising:

a mandrel;

at least one device coupled to the mandrel and disposed between first and second portions of the wellbore;

a matrix material disposed in the vicinity of the device; and at least one sensor embedded in the matrix material;

the tool adapted to attain a first configuration in which relative movement between the device and the wellbore is permitted when the downhole tool extends within the wellbore, and a second configuration in which the device engages an inner surface of the wellbore so that relative movement between the device and the wellbore is generally prevented so that when one or more loads are applied on the tool in response to the engagement between the device and the inner surface of the wellbore, at least one of the one or more loads is sensed by the at least one sensor.

3. The tool of claim 2 further comprising a braid embedded in the matrix material, and wherein the sensor is embedded in the braid.

4. The tool of claim 3 wherein the matrix material and the braid are formed into sheets, and wherein the sheets are laminated together.

5. The tool of claim 2 further comprising electrical conductors connected to the sensor and located in the matrix material.

6. The tool of claim 2 wherein at least a portion of the mandrel is fabricated from the material so that the at least one sensor is embedded in the at least a portion of the mandrel.

7. A downhole tool adapted to extend within a wellbore, the tool comprising:

a mandrel;

at least one device coupled to the mandrel and disposed between first and second portions of the wellbore;

a braid disposed in the vicinity of the device; and at least one sensor embedded in the braid;

the tool adapted to attain a first configuration in which relative movement between the device and the wellbore is permitted when the downhole tool extends within the wellbore; and a second configuration in which the device engages an inner surface of the wellbore so that relative movement between the device and the wellbore is generally prevented so that when one or more loads are applied on the tool in response to the engagement between the device and the inner surface of the wellbore, at least one of the one or more loads is sensed by the at least one sensor.

8. The tool of claim 7 wherein the braid comprises a single strand or multiple strands woven in a fabric form.

9. The tool of claim 2 or 7 wherein the device comprises a sealing element adapted to sealingly engage the inner surface of the wellbore when the assembly is in the second configuration, and further comprising a shoe associated with the sealing element and fabricated from the material so that the at least one sensor is embedded in the shoe.

10. The tool of claim 2 or 7 wherein the device comprises at least two sealing elements adapted to sealingly engage the inner surface of the wellbore when the assembly is in the second configuration, and further comprising a spacer ring extending between the sealing elements and fabricated from the material so that the at least one sensor is embedded in the spacer ring.

11. A downhole tool adapted to extend within a wellbore, the tool comprising:

a mandrel;

at least one device coupled to the mandrel and disposed between first and second portions of the wellbore;

a plurality of laminated sheets in the vicinity of the device; and at least one sensor embedded between two adjacent sheets;

the tool adapted to attain a first configuration in which relative movement between the device and the wellbore is permitted when the downhole tool extends within the wellbore; and a second configuration in which the device engages an inner surface of the wellbore so that relative movement between the device and the wellbore is generally prevented so that when one or more loads are applied on the tool in response to the engagement between the device and the inner surface of the wellbore, at least one of the one or more loads is sensed by the at least one sensor.

12. A method comprising:

providing a packer adapted to extend within a wellbore, the packer comprising at least one sealing element fabricated from a first material and adapted to sealingly engage the wellbore;

providing a second, non-metallic, material;

embedding a sensor in the non-metallic material; and disposing the sensor adjacent the sealing element;

wherein, when the packer extends within the wellbore, the sensor is adapted to sense one or more loads transmitted to the sealing element.

13. A method comprising:

coupling at least one device to a mandrel;

disposing a matrix material in the vicinity of the device;

embedding at least one sensor in the matrix material;

extending the mandrel within the wellbore so that relative movement between the device and the wellbore is permitted;

engaging the device with an inner surface of the wellbore so that relative movement between the device and the wellbore is generally prevented;

wherein one or more loads are applied on the mandrel in response to engaging the device with the inner surface of the wellbore; and sensing at least one of the one or more loads using the at least one sensor.

14. The method of claim 13 wherein embedding the at least one sensor in the matrix material comprises the steps of:

embedding the at least one sensor in a braid; and embedding the braid in the matrix material.

15. A method comprising:

coupling at least one device to a mandrel;

disposing a braid in the vicinity of the device;

embedding at least one sensor in the braid;

extending the mandrel within the wellbore so that relative movement between the device and the wellbore is permitted;

engaging the device with an inner surface of the wellbore so that relative movement between the device and the wellbore is generally prevented;

wherein one or more loads are applied on the mandrel in response to engaging the device with the inner surface of the wellbore; and sensing at least one of the one or more loads using the at least one sensor.

16. The method of claim 15 wherein the braid comprises a single strand or multiple strands woven in a fabric form.

17. A method comprising:

coupling at least one device to a mandrel;

disposing a laminated structure in the vicinity of the device, the structure having a plurality of sheets laminated together;

disposing at least one sensor between two adjacent sheets;

extending the mandrel within the wellbore so that relative movement between the device and the wellbore is permitted;

engaging the device with an inner surface of the wellbore so that relative movement between the device and the wellbore is generally prevented and the device defines and is disposed between, first and second portions of the well bore;

wherein one or more loads are applied on the mandrel in response to engaging the device with the inner surface of the wellbore; and sensing at least one of the one or more loads using the at least one sensor.

18. A method comprising:

coupling at least one device to a mandrel;

disposing a non-metallic material in the vicinity of the device;

embedding a plurality of stress-sensing sensors in the material;

extending the mandrel within the wellbore so that relative movement between the device and the wellbore is permitted;

engaging the device with an inner surface of the wellbore so that relative movement between the device and the wellbore is generally prevented;

wherein one or more loads are applied on the mandrel in response to engaging the device with the inner surface of the wellbore; and sensing at least one of the one or more loads using the at least one sensor, each sensor being adapted to store data relating to the sensed stress independently from the other sensors.

19. The method of claim 18 further comprising the step of connecting the sensors to central storage/calibration electronics which receives the sensed stress data from all of the sensors.

20. The method of claim 19 wherein the sensors are hardwired to the electronics.

21. The method of claim 19 wherein the sensors are connected to the electronics via high frequency, radio frequency, electromagnetic, or acoustic telemetry.

22. The method of claim 19 wherein the electronics combine the outputs of the sensors to form a virtual sensor anywhere on the tool.

23. The method of claim 22 further comprising the step of utilizing the electronics to estimate the stress at any point on the tool including the actual sensor locations.

24. The method of claim 19 further comprising the step of utilizing the electronics to calibrate the sensors to compensate for sensor misalignment.

25. An apparatus comprising:

a mandrel adapted to extend within a wellbore, the mandrel comprising at least one packer element fabricated from a first material;

a device extending around the mandrel and located adjacent the packer element, at least a portion of the device being fabricated from a non-metallic material; and a sensor embedded in the non-metallic material;

wherein the sensor is adapted to sense one or more loads transmitted to the at least one packer element and wherein the device is selected from the group consisting of a shoe and a spacer ring.

26. A downhole tool adapted to extend within a wellbore, the downhole tool comprising:

a mandrel;

one or more packer elements coupled to the mandrel and adapted to sealingly engage the inner surface of the wellbore and isolate a first portion of the wellbore from a second portion of the wellbore;

a device coupled to the mandrel and disposed between first and second mandrel portions;

the device adapted to engage the wellbore in a manner so that relative movement between the device and the wellbore is generally prevented and so that one or more loads are applied on the mandrel in response to the engagement between the device and the inner surface of the wellbore;

a non-metallic material disposed in the vicinity of the device;

at least one sensor embedded in the material for sensing one or more of the loads; and a shoe extending around the mandrel and engaging an end of one of the one or more packer elements, at least a portion of the shoe being fabricated from the material.

27. A downhole tool adapted to extend within a wellbore, the downhole tool comprising:

a mandrel;

at least two packer elements coupled to the mandrel and adapted to sealingly engage the inner surface of the wellbore and isolate a first portion of the wellbore from a second portion of the wellbore;

a device coupled to the mandrel and disposed between first and second mandrel portions;

the device adapted to engage the wellbore in a manner so that relative movement between the device and the wellbore is generally prevented and so that one or more loads are applied on the mandrel in response to the engagement between the device and the inner surface of the wellbore;

a non-metallic material disposed in the vicinity of the device;

at least one sensor embedded in the material for sensing one or more of the loads; and a spacer ring extending between the two packer elements, at least a portion of the spacer ring being fabricated from the material so the at least one sensor is disposed between the two packer elements.

28. The tool of claim 26 or 27 wherein the device comprises at least one slip element, wherein the at least one slip element grips the inner surface of the wellbore;

and wherein the material is attached to the at least one slip element.

* * * * *